United States Patent [19]

Huldén

[11] Patent Number: 5,024,010

[45] Date of Patent: Jun. 18, 1991

[54] DEVICE IN A QUICK COUPLING

[75] Inventor: Fritiof Huldén, Molkom, Sweden

[73] Assignee: Svets- & Maskinprodukter i Lidkoping AB, Lidkoping, Sweden

[21] Appl. No.: 457,686

[22] PCT Filed: Jul. 14, 1988

[86] PCT No.: PCT/SE88/00378

§ 371 Date: Dec. 29, 1989

§ 102(e) Date: Dec. 29, 1989

[87] PCT Pub. No.: WO89/00632

PCT Pub. Date: Jan. 26, 1989

[30] Foreign Application Priority Data

Jul. 20, 1987 [SE] Sweden ..... 8702910

[51] Int. Cl.[5] ..... E02F 3/28

[52] U.S. Cl. ..... 37/118 R; 414/723

[58] Field of Search ..... 414/686, 723; 37/118 R, 37/118 A

[56] References Cited

U.S. PATENT DOCUMENTS 3,934,738 1/1976 Arnold ..... 414/723

4,179,225 12/1979 Asplund ..... 403/322

4,586,867 5/1986 Stafford ..... 403/322 X 4,929,143 5/1990 Dohnalik ..... 172/272 X

FOREIGN PATENT DOCUMENTS 0058058 8/1982 European Pat. Off. .

WO83/03629 10/1983 PCT Int'l Appl. .

WO84/02152 6/1984 PCT Int'l Appl. .

*Primary Examiner*—Dennis L. Taylor

*Assistant Examiner*—Arlen L. Olsen

*Attorney, Agent, or Firm*—Nixon & Vanderhye

[57] ABSTRACT

A detachable coupling for connecting an implement, e.g. bucket, to an excavator. The coupling has two parallel link arms that are pinned to the operating arms of the excavator. A locking unit held between these arms has a slidable tension pin that engages a wedge support affixed to the implement. Two pins at either end of the locking device fit loosely into apertures in the link arms. When the tension spring is wedged against the wedge support, the pins are pressed against a surface of the aperture in the link arms to form a rigid coupling between the implement and excavator.

6 Claims, 6 Drawing Sheets

DEVICE IN A QUICK COUPLING

BACKGROUND AND SUMMARY OF THE INVENTION

The present invention relates to a device in a quick coupling for detachably coupling a working implement to the operating arm of an excavating machine, said quick coupling comprising two parallel link arms supported by the operating arm, each link arm having an abutment portion with a support surface, and a locking means comprising a stationary wedge support attached to the working implement with an engagement surface facing the working implement and a movable tension pin displaceable by a power cylinder and having an engagement surface for wedging cooperation with the engagement surface of the wedge support, said locking means having support surfaces to cooperate by means of pressure with the support surfaces of the link arms.

A quick coupling of the type described above has proved advantageous in several respects and has enjoyed wide practical use. It has the following advantages, for instance It has extremely low weight (about 30 kgs for a machine up to 14 tons) and therefore saves material, as well as being light to use and assamble; the construction is simple, making it quick and easy to mount the bucket to the excavating machine; it has no intermediate elevational piece which would cause building height and increased weight; thanks to its low weight it does not necessitate altering the bucket volume; it enables the force-absorbing dome of the bucket to be retained, thanks to the link arm construction in that the link arms may have an arc-shape adapted to the dome; it entails improved, even optimum conditions for the force transmission between bucket and operating arm and the link arms are not affected to any noticeable extent since the forces are transmitted directly to the hooks from the stick and vice versa via the stick shaft and sleeve, if any, abutting the hooks; thanks to its design and to said improved force transmission, the stipulated geometry of the bucket can be retained; it withstands diagonal breaking movements of the bucket since the link arms make the coupling resilient, because of the fact that the link arms have no rigid, stiffening joint between them and they can therefore move freely up and down at their end portions at the four contact points with the bucket, independently and in relation to each other and will thus always follow the diagonal breaking movements of the bucket when this is temporarily deformed and becomes distorted by lateral point stresses during work; it maintains a play-free joint between implement and operating arm at the contact points between operating-arm attachment means and hooks, even when the link arms follow the diagonal breaking movements of the bucket; it is self-adjusting with respect to any slight wear which may occur at the contact surfaces, and a play-free joint is thus always guaranteed.

The quick coupling described above and known through patent specification EP 0 139 652 is designed for manual locking with the aid of a wedge-like tension pin which the operator forces into the desired locking position in the quick coupling with the aid of a suitable tool. Although the manual effort required is relatively little, there has been increased demand for the actual locking step with the tension pin to be carried out automatically from the driver's cab. The problem has been to achieve a hydraulically controlled locking device which is reliable to use, simple to manufacture and install, can be mounted without affecting the other features and functions of the quick coupling, does not increase the dimensions of the quick coupling, can be mounted in a protected place to avoid damage and dirt and which is relatively inexpensive to manufacture.

The object of the present invention is to provide a locking device for a quick coupling of hydraulic or pneumatic type which can be operated from the driver's cab, and which solves the problem mentioned above. An essential advantage of the locking device according to the invention is also that it can be manufactured as an ancillary unit for already existing quick couplings, thus converting them simply from manual to hydraulic or pneumatic insertion of the tension pin without any structural alterations having to be performed on the quick coupling.

This is obtained according to the present invention in that the locking means comprises a locking unit supported by the link arms, said locking unit having a rigid housing extending between the link arms, in which the tension pin is axially displaceable by the power cylinder between, in relation to the wedge support, an outer free position and an inner locking position, said housing having an opening located at a central portion thereof and disposed vertically in line with the wedge support of the working implement for friction-free receipt of the wedge support therein when the tension pin is in its free position, that the housing is provided with opposite supporting pins axially aligned to each other and arranged removably and with clearence freely to be received in opposite openings in the link arms, said supporting pins and openings being provided with said pressure-cooperating support surfaces, that the tension pin is of such sufficient length that its front end portion located at the engagement surface in locking position of the tension pin is positioned in a cavity of the housing and has a support surface for pressure-cooperation with a support surface in the cavity, and that one of the supporting pins is provided with a through-hole to receive a rear end portion of the tension pin in its locking position.

BRIEF DESCRIPTION OF THE DRAWINGS

The invention will be described further in the following, with reference to the accompanying drawings.

DESCRIPTION OF PREFERRED EMBODIMENT

Figure 1:
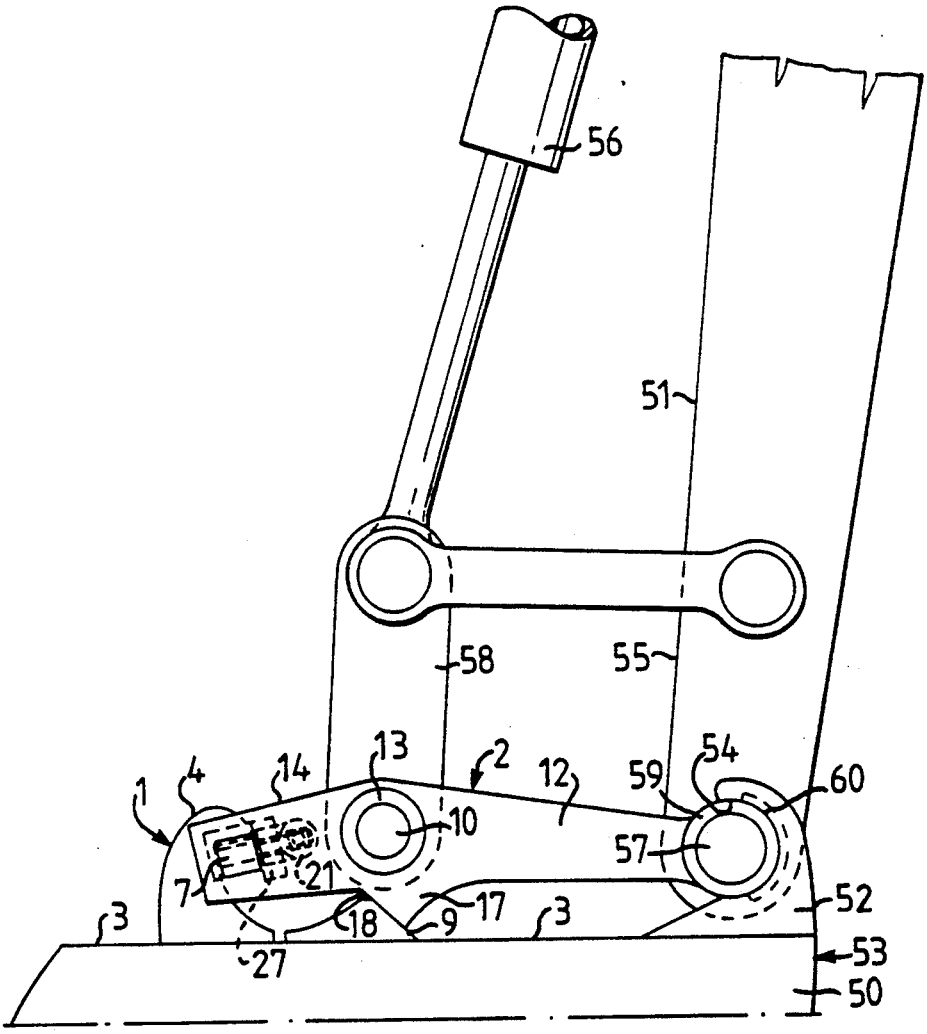
FIG. 1 shows schematically from the side the outer end portion of the operating arm of an excavating machine, and top portion of a bucket connected to the operating arm via a quick coupling with a locking device according to the present invention.

With reference to FIG. 1 the locking device according to the invention relates to a quick coupling of the type described in patent specification EP 0 139 652 for detachably coupling a working implement 50 to the operating arm 51 of an excavating machine, and which includes an attachment means 1 for the implement 50 and an attachment means 2 for the operating arm 51. The implement attachment means 1 is arranged on an outwardly facing surface 3 which may be the upper side of the working implement 50, for instance a bucket, or of a separate plate for attachment onto the working implement 50, or the upper side of a rotator, for instance, carrying the working implement.

Figure 3:
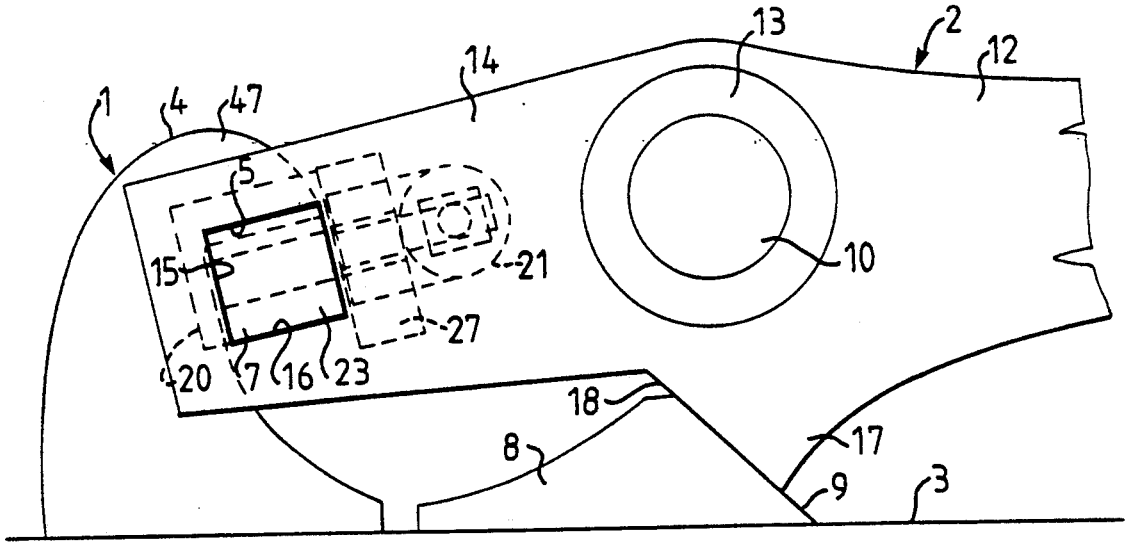
FIG. 3 shows schematically parts of the quick coupling with the locking device according to FIG. 1, seen from the side.
Figure 4:
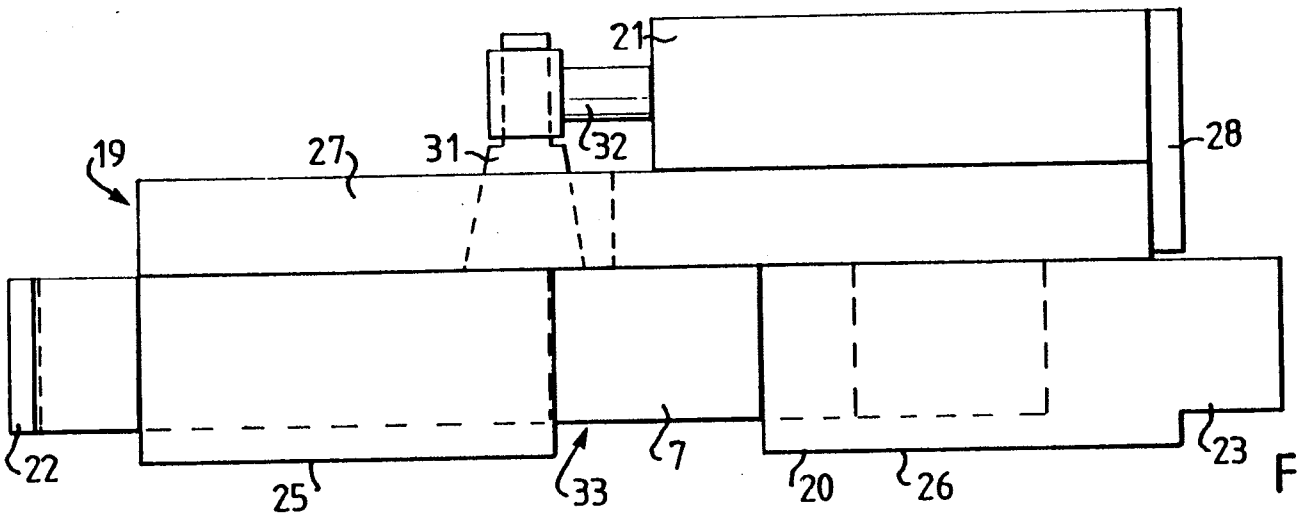
FIGS. 4 and 5 show the locking device according to FIGS. 1 to with a tension pin in locking position, seen from above and from the side, respectively.
Figure 5:
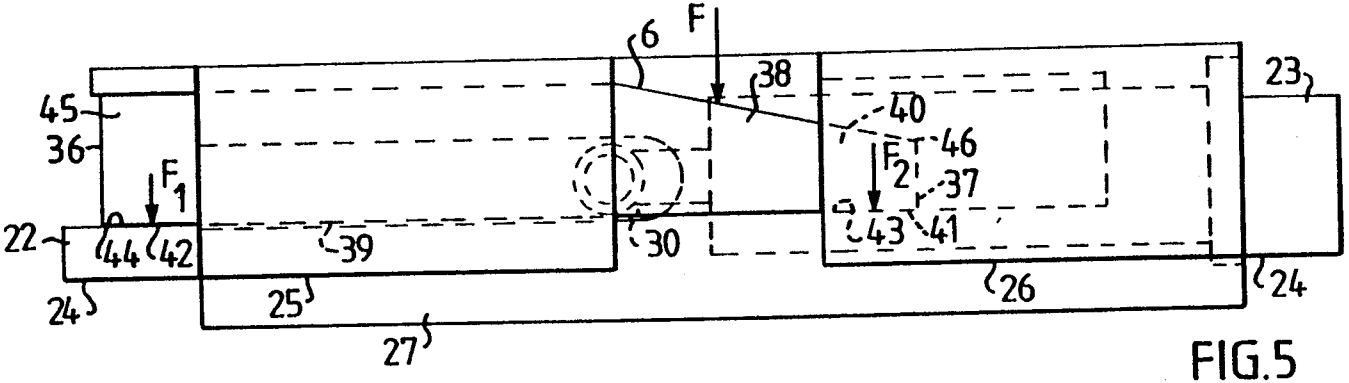

The implement attachment means 1 comprises a coupling device in the form of two hooks 52, spaced from each other and welded to said surface 3 at the front edge of the bucket opening 53, and open towards the upper side 3 of the bucket 50 to form semi-cylindrical support surfaces 54 for intimate cooperation with corresponding support surfaces of the operating arm attachment means 2. The implement attachment means 1 is provided with a hook-like wedge support 4 secured to the upper side 3 of the bucket 50 at its center line extending between said hooks 52. The wedge support 4 is positioned a predetermined distance from the hooks 52 and is provided with a functional engagement surface 5 (FIG. 3) facing down towards the upper side 3 of the bucket 50 to cooperate with a corresponding engagement surface 6 (FIG. 5) on a displaceable tension pin 7 as will be explained below. The wedge support 4 and tension pin 7 constitute parts of a locking means of the quick coupling.

The implement attachment means 1 is also provided with two shoulder-like counter members 8 (FIG. 3) welded to the upper side 3, said counter members 8 being aligned with the hooks 52 and arranged between the wedge support 4 and the hooks 52, in the vicinity of the wedge support 4, i.e. at some considerable distance from the hooks 52. Each counter member 8 has a flat, functional support surface 9, located in the same plane and inclined inwardly towards the hooks 52 to cooperate with corresponding support surfaces on the operating arm attachment means 2 of the operating arm, as will be explained below.

As shown in FIG. 1 the operating arm 51 of the excavating machine comprises a stick 55 and a hydraulic operating cylinder 56 arranged on the front side of the stick 55 (facing away from the excavating machine}. At its free end the stick 55 is provided with a horizontal pin or shaft 57 pivotably carrying the bucket 50 and thus forming the center of oscillation of the bucket 50, while the hydraulic cylinder 56 either directly, or indirectly via links 58, is provided with a horizontally arranged pin or shaft 10 lying parallel to the stick shaft 57 and thus located in front of this and joined to the bucket 50 to give a controlled swinging movement of the bucket 50 about the center of the stick shaft 57.

The stick shaft 57 and the shaft 10 form parts of an attachment means 2 of the operating arm 51, which also includes a link means in the form of two parallel link arms 11, 12 (FIGS. 1 and 2), each comprising a shaft support means 58 located at one end of the link arm, in the form of a sleeve or bushing, for instance, with a horizontal hole to receive the stick shaft 57 and a shaft support means arranged at a predetermined distance from said hole in the form of a cylindrical sleeve 13 with a horizontal hole to receive the shaft 10. The sleeve 58 disposed at said one end has on its outer side a functional, concave or semi-cylindrical support surface 60 extending transversely or axially (in relation to the stick shaft 57), having a predetermined radius corresponding to the radius of the semi-circular support surfaces 54 of the hooks 52. Maximum contact is thus obtained between these support surfaces 54, 60. The support surfaces 54 of the hooks 52 preferably encompass the largest possible sector angle, i.e. 180° The support surface 60 of the sleeve 58 cooperating with the hooks 52 is thus located immediately outside the stick shaft 57, as close to this as is permitted by the wall thickness of the sleeve 58, suitably about 15 mm. The support surface 60 is also located in line with and on both sides (similarly) of the central plane running through the centers of the shafts 10, 57, and on the side of the stick shaft 57 facing away from the link arms 11, 12.

Each link arm 11, 12 comprises an abutment portion 14 (FIGS. 1 to 3) protruding freely in a backward direction from the shaft 10, i.e. in the backwardly extension of the link arm 11, 12, and forms an obtuse angle with the waist of the link arm, located between the shafts 10, 57. The abutment portion 14 is provided with a through-going rectangular opening 15, the lower limit of which forms a functional, flat support surface 16, arranged to cooperate under pressure with a corresponding support surface of a supporting pin of said locking means, as will be described below. The two openings 15 are arranged in line with each other.

Furthermore, each link arm 11, 12 is provided immediately below the sleeves 13 with a counter member 17 (FIG. 3) designed with a functional, flat support surface 18 arranged to engage with said functional support surface 9 of the counter member 8 of the bucket attachment means 1 to form a wedge effect. Said functional support surfaces 9, 18 incline towards the hooks 52 with the same inclination. The inclination is such that an extended plane of the support surfaces 18 of the counter members 17 forms an acute angle with an extended plane of the support surfaces 16 of the abutment portions 14, in order to achieve the required wedge-effect when the link arms 11, 12 are clamped between the fixed wedge support 4 and the hooks 52 on the bucket 50 via the counter members 17 with the aid of the displaceable tension pin 7 of the locking means.

Figure 2:
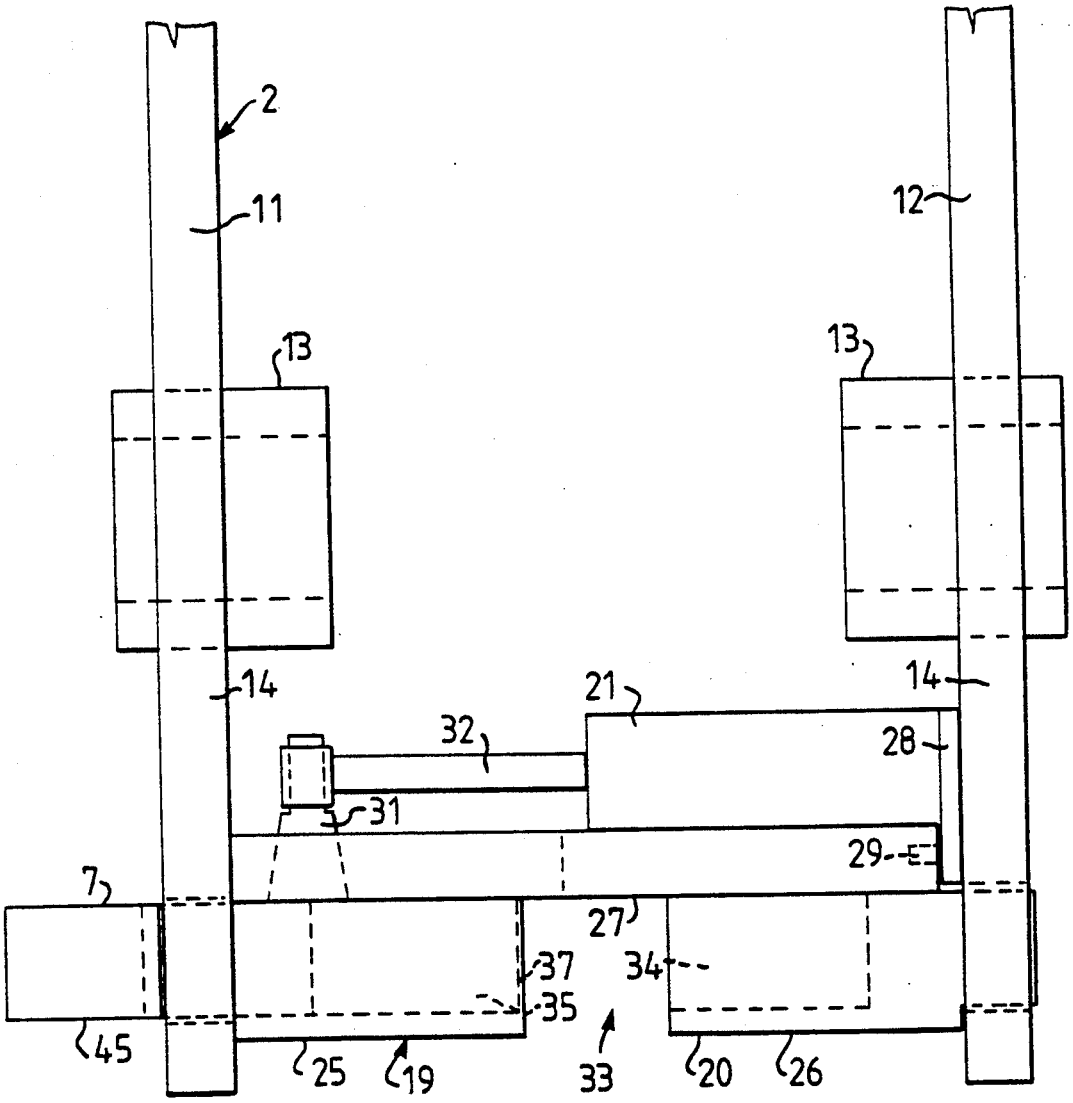
FIG. 2 shows schematically from above parts of the quick coupling with the locking device according to FIG. 1.

According to the present invention the locking means of the quick coupling comprises a separate locking unit 19 (FIGS. 2 and 4 to 7) having an elongate housing 20 to receive the tension pin 7, and a hydraulic cylinder 21 to move the tension pin 7 between an outer free position and an inner locking position in relation to the wedge support 4. At its opposite end parts the housing 20 is provided with supporting pins 22, 23 inserted in the openings 15 of the link arms 11, 12. The lower sides of the supporting pins 22, 23 thus form functional support surfaces 24 for cooperation with the support surfaces 16 of the openings 15. The supporting pins 22, 23 are so dimensioned in relation to the openings 15 that they can easily be inserted without friction into their positions in the openings 15, providing a loose play joint which will allow the link arms 11, 12 to move freely in relation to each other when the quick coupling is subjected to breaking forces or other stresses, as explained in said patent specification EP 0 139 652. In the embodiment shown the housing 20 is divided into a first part 25 and a second part 26, from which said pins 22, 23 protrude. The parts 25, 26 of the housing 20 are aligned with and rigidly connected to each other by a connecting element 27 extending substantially between the link arms 11, 12 and mounted on the side of the housing parts 25, 26 located nearest to the shaft 10. The hydraulic cylinder 21 of the locking unit 19 extends along the side of the connecting element 27 facing away from the housing parts 25, 26 and is attached to the connecting element 27 in a suitable manner, e.g. detachably as shown in FIG. 2, by means of a lateral extension of the end plate 28 of the hydraulic cylinder 21, said end plate 28 being provided with a pin 29 for friction-free insertion into a corresponding hole in the end of the connecting element 27, which is thus shortened to leave space for the end plate 28. Furthermore, the connecting element 27 is also provided with a longitudinal slot 30 (FIGS. 5 and 7), through which a side pin 31 of the tension pin 7 extends to connect the tension pin 7 to the piston-rod 32 of the hydraulic cylinder 21. The slot 30 is somewhat longer than the length of the first housing part 25. The housing 20 is provided with an opening 33, freely accessible at least from below and in front, said opening being formed as a gap in that the housing parts 25, 26 being spaced from each other. The opening 33 is located in the vertical center plane of the quick coupling and is slightly wider than the width of the wedge support 4, allowing the wedge support to be received in the opening 33 without inconvenience when the bucket and operating arm is coupled together via the quick coupling.

The second housing part 26 is provided with a cavity 34 (FIGS. 2 and 5) of sufficient height and axial extension (with respect to the housing 20) to permit requisite axial displacement of the tension pin 7 in the second housing part 26 when actuated by the hydraulic cylinder 21. The first housing part 25 is also provided with a cavity 35 which is, however, through-going and has a cross-sectional area slightly larger than that of the tension pin 7 allowing the tension pin 7 to move to and fro therein without obstruction when influenced by the hydraulic cylinder 21. The supporting pin 22 pertaining to the first housing part 25 is provided with a through-hole 36 forming an extension of the cavity 35 in the housing part 25, so that the rear end portion 45 of the tension pin 7 can be moved freely through the supporting pin 22 in a direction out from the link arm 11 when actuated by the hydraulic cylinder 21.

Figure 8:
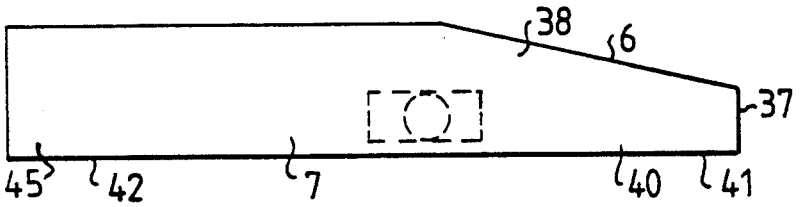
FIGS. 8 and 9 show the tension pin of the locking device, seen from the side and from above, respectively.
Figure 9:
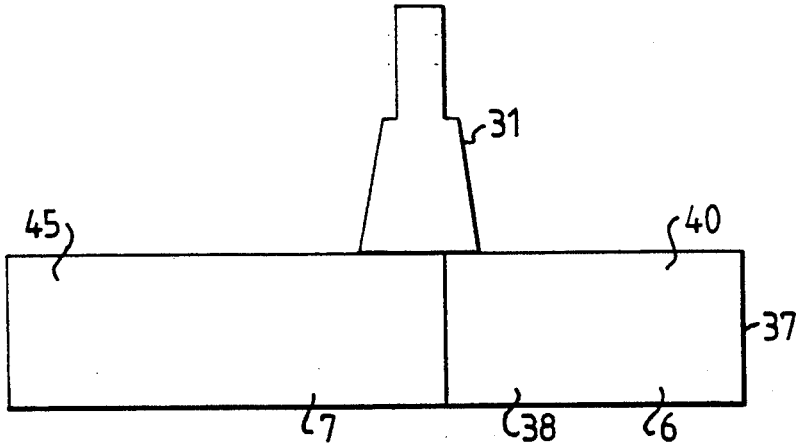

The tension pin 7, shown in more detail in FIGS. 8 and 9 is elongate with rectangular cross-section increasing from the foremost end 37 to form a wedge portion 38 having on its upper side a functional, flat engagement surface 6. The wedge portion 38 is of predetermined length, its length being greater than the width of the wedge support opening 33, so that when the tension pin 7 is inserted in locking position, a sufficient length of its front end portion 40 will be located in the cavity 34 of the second housing part 26. However, this end portion 40 must at the same time be sufficiently short when the tension pin 7 is fully withdrawn to its free position, for the front end 37 to be located in the cavity 35 of the first housing part 25, free from the wedge support 4, thus allowing the bucket to be disconnected from the quick coupling. The engagement surface 6 of the wedge portion 38 has the same inclination as the engagement surface 5 of the wedge support 4 so that the desired wedge-effect is obtained. The lower side of the tension pin 7 has functional front and rear support surfaces 41. 42 for cooperation under pressure with corresponding inner support surfaces 43, 44 (FIG. 5) on the second housing part 26 and the supporting pin 22 of the first housing part 25. The intermediate surface 39, located in the first housing part 25 seen in the locking position of the tension pin 7, is thus free from pressure cooperation with this housing part 25. The length of the tension pin 7 is sufficient so that a rear end section 45 is obtained having an axial extension substantially equivalent to the thickness of the link arm 11. The tension pin 7 itself thus compensates for the weakening effect resulting from the shape of the supporting pin 22 with at least one relatively thin bottom wall so that the supporting pin 22 is reinforced by the inner tension pin 7 when inserted and maintained in its locking position by the hydraulic cylinder 21. Furthermore, the wedging force F (FIG. 5) existing in locking position is distributed between a larger partial force $F_2$ exerted on the front end section 40, and a smaller partial force $F_1$ exerted on the supporting pin 22. This advantageous distribution is thus obtained by the end section 40 being located closer than the rear end section 45 to the wedge position where the wedge-force F is exerted.

Figure 6:
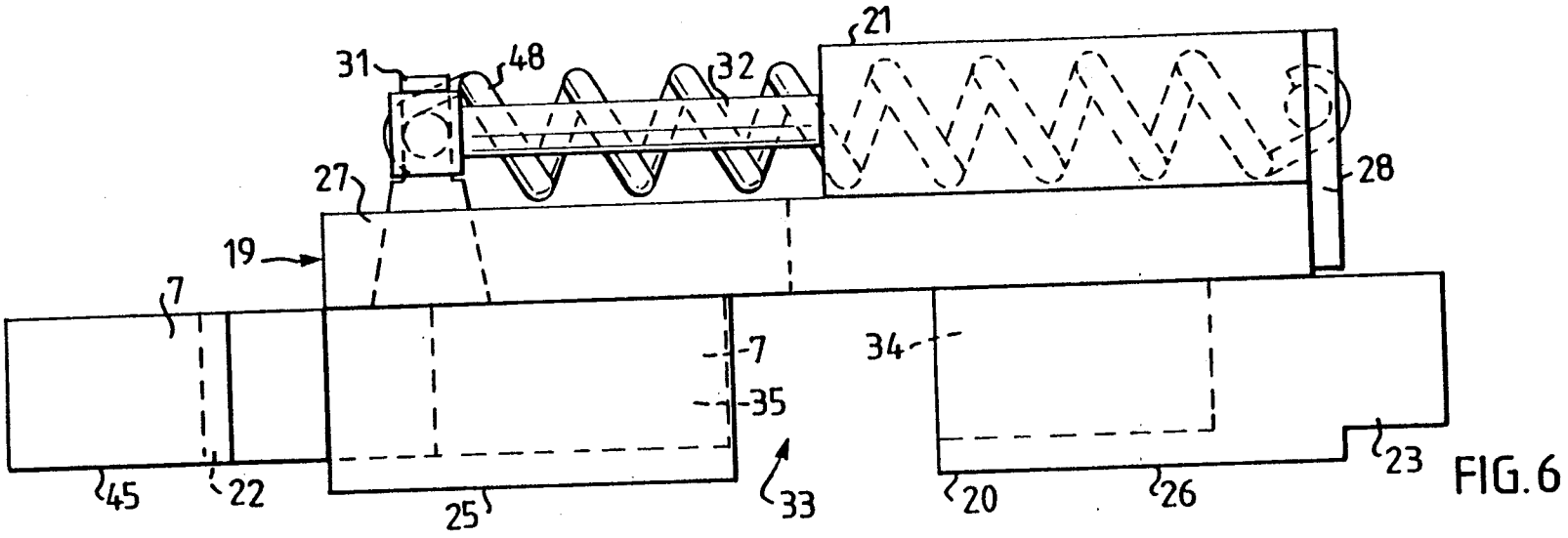
FIGS. 6 and 7 show the locking device with its tension pin in free position, seen from above and from the side, respectively.
Figure 7:
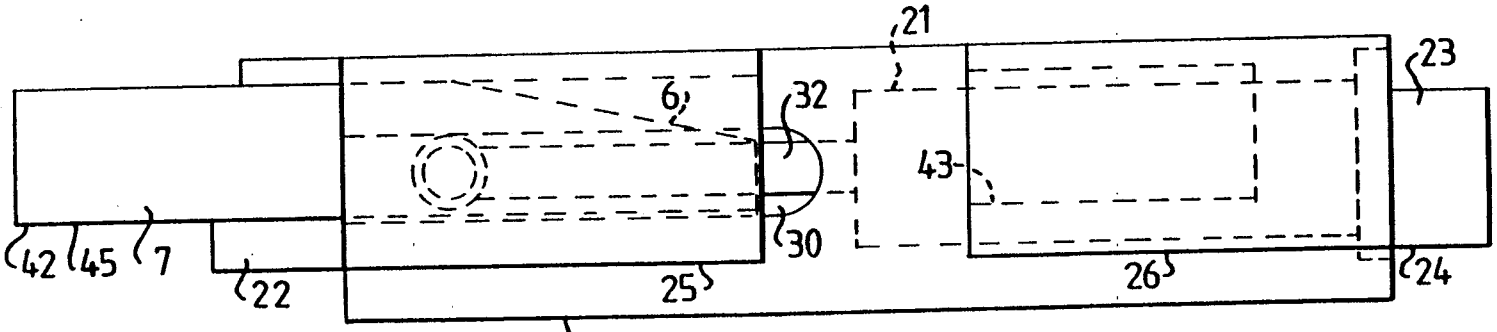

As is clear from FIG. 6, one end of a tension spring 48 is secured to the lower side of the hydraulic cylinder 21, its other end being secured to the outer end of the piston rod 32. This tension spring 48, which has been omitted in the other figures for the sake of simplicity, endeavours to retain the piston rod 32 in the hydraulic cylinder 21, and thus the tension pin 7 in locking position. The tension spring 48 thus constitutes a safety device in the event of the hydraulic pressure failing in the cylinder if the hoses to the hydraulic cylinder become damaged, for instance. Besides this safety device, the safety system also includes a pilot-controlled non-return valve which forms a hydraulic lock in the hydraulic circuit which ensures that the necessary pressure is always maintained in the hydraulic cylinder when the tension pin 7 assumes locking position. Moreover, double control means, independent of each other, are provided in the driver's cab for connection of the hydraulic cylinder 21.

In the embodiment shown the double-acting hydraulic cylinder 21 is disposed so that its greatest force is utilized to move the tension pin 7 out of its locking position. This is advantageous in view of the wedge forces which must be momentarily overcome then. Since the hydraulic rod 32 takes up part of the pressure surface on the piston only a small force is obtained when the tension pin 7 is moved to locking position. However, this has proved sufficient to achieve the desired wedge-effect.

The bucket 50 is coupled extremely quickly and easily to the operating arm 51 of the excavating machine by means of the quick coupling described. The first step is to adjust the operating arm 51 so that the stick shaft 57 is brought into direct engagement with the hooks 52 of the bucket 50, after which the counter member 8 of the bucket 50 and the counter member 17 of the link arms 11, 12, by connection of the hydraulic cylinder of the operating arm 51, are brought into alignment with each other at said support surfaces 9. In this starting position the wedge support 4 of the bucket 50 is located in the opening 33 between the two housing parts 25, 26 of the locking unit 19 and the upper edge 46 at the front end 37 of the tension pin 7 is located in a sufficiently low level in relation to the engagement surface 5 of the wedge support 4 for the tension pin 7 to be moved in under the lip 47 of the wedge support 4 by connection of the hydraulic cylinder 21. The engagement surfaces 5 and 6 thus achieve a permanent wedge-action and a play-free joint is obtained. The wedge-force thus produced is transmitted to the slidingly cooperating counter members 8, 17 so that the support surfaces 18 of the link-arm counter-members 17 slide down along the support surfaces 9 of the counter member 8 of the bucket attachment means. This sliding movement builds up a permanent wedge-force which results in increased permanent abutment of the shaft sleeves 59 against the hooks 52 so that a permanent joint is obtained, entirely play-free, this abutment force against the hooks 52 deriving from said wedge-forces transmitted via the counter members 8, 17.

The play-free joint thus obtained will be subject to very little wear. Such a little wear as does occur will not in any case give rise to any clearance since it is automatically and immediately compensated by the inherent wedge-force so that the joint remains play-free and a wedge-force is always maintained since the hydraulic cylinder 21 constantly exerts pressure on the tension pin 7. In other words, the joint is self-adjusting.

The openings 15 in the link arms 11, 12 are provided in an existing quick coupling on the market to receive a through-going tension pin which is inserted manually with the aid of a tool to produce a wedge-action with the wedge support 4. The supporting pin 22, 23 of the locking unit 19 are designed to fit into these openings 15: This enables both new and old quick couplings of the described link-arm type to be equipped with a hydraulic or pneumatic locking unit 19 according to the present invention. In the latter case the unit may be considered an ancillary unit for quick couplings existing on the market enabling them to be easily converted to automatic locking control from the driver's cab, either hydraulically or pneumatically.

I claim:

1. A device in a quick coupling for detachably coupling a working implement to the operating arm of an excavating machine, said quick coupling comprising two parallel link arms supported by said operating arm, each link arm having an abutment portion with a support surface, and a locking means comprising a stationary wedge support attached to said working implement with an engagement surface facing the working implement and a movable tension pin displaceable by a power cylinder and having an engagement surface for wedging cooperation with the engagement surface of the wedge support, said locking means having support surfaces to engage by means of pressure the support surfaces of the link arms, and comprising a locking unit supported by said link arms, said locking unit having a rigid housing extending between the link arms, in which the tension pin is axially displaceable by said power cylinder between an outer free position clear of said wedge support and an inner locking position engaged with said wedge support, said housing having an opening located at a central portion thereof and disposed vertically in line with said wedge support of the working implement for receipt of the wedge support therein when the tension pin is in its free position, said tension pin in said locking position transverses said central portion, and said housing being provided with opposite supporting pins axially aligned to each other and arranged to be removably received with clearance in opposite openings in said link arms, said supporting pins and openings being provided with said pressure-cooperating support surfaces, said tension pin being of such sufficient length that its front end portion located at said engagement surface in locking position of the tension pin is positioned in a cavity of the housing and as a support surface for pressure-cooperation with a support surface in the cavity, and one of said supporting pins being provided with a through-hole to receive a rear end portion of said tension pin in its locking position.

2. A device according to claim 1, characterized in that said rear end portion (45) of the tension pin (7) is provided with a support surface (42) which cooperates under pressure with a support surface (44) of the aperture (36) in the supporting pin (22).

3. A device according to claim 1 or 2, characterized in that the part (25) of the housing (20) which is located between the opening (33) for the wedge support (4) and the supporting pin (22) provided with the aperture (36), has a bottom surface which by clearance is free from pressure-cooperation with the tension pin (7).

4. A device according to claim 1 or 2, characterized in that the tension pin (7) is of sufficient length for said rear end portion (45), seen in locking position of the tension pin (7), to have an axial extension substantially corresponding to the thickness of the link arm (11).

5. A device according to claim 1, characterized in that the locking unit (19) forms an ancillary unit for existing quick couplings to convert them hydraulically or pneumatically from manual to automatic locking from a driver's cab, the opposite openings (15) of the link arms (11, 12) for the manually insertable tension pin being utilized to detachably and with clearance, mount the opposite supporting pins (22, 23) of the locking unit (19).

6. A detachable coupling for coupling an implement to a plurality of operating arms comprising:

a plurality of link arms rotatably connected to said arms, each link arm having an abutment portion with a link support surface, a counter member and an opening;

a wedge support affixed to said implement at a position laterally central to and longitudinally displaced from said link arms, said wedge support having an oblique wedge surface facing said implement;

at least one shoulder counter affixed to said implement at a position to engage said counter member of the link arm; and a locking unit comprising a lock support surface rigidly coupled to outer pins extending into said apertures of the link arms, a central opening aligned with said wedge support, and a movable tension pin traversing said central opening in a first position and clear of said opening in a second position, said pin having a oblique pin surface abutting said wedge surface such that said pin is wedged between the wedge support and the lock support surface when said pin is in said first position.

* * * * *